US005896843A

United States Patent [19]

Lorraine

[11] Patent Number: 5,896,843

[45] Date of Patent: Apr. 27, 1999

[54] FUEL RAIL DAMPER

[75] Inventor: Jack R. Lorraine, Newport News, Va.

[73] Assignee: Siemens Automotive Corporation, Auburn Hills, Mich.

[21] Appl. No.: 08/976,786

[22] Filed: Nov. 24, 1997

[51] Int. Cl.[6] ..... F02M 37/04

[52] U.S. Cl. ..... 123/467; 123/447; 123/456

[58] Field of Search ..... 123/447, 456, 123/467; 138/26, 27, 28, 30

[56] References Cited

U.S. PATENT DOCUMENTS

| | | | |
|---|---|---|---|
| 4,205,637 | 6/1980 | Ito | 123/456 |
| 4,274,446 | 6/1981 | Zahid | 138/30 |
| 4,328,836 | 5/1982 | Petrie | 138/30 |
| 4,514,151 | 4/1985 | Anders | 138/26 |
| 4,615,320 | 10/1986 | Fehrenbach et al. . | |
| 4,649,884 | 3/1987 | Tuckey . | |
| 4,660,524 | 4/1987 | Bertsch et al. . | |
| 4,679,537 | 7/1987 | Fehrenbach et al. . | |
| 4,729,360 | 3/1988 | Fehrenbach et al. . | |
| 5,027,777 | 7/1991 | DeBruyn et al. . | |
| 5,038,828 | 8/1991 | Fonser | 138/26 |
| 5,088,463 | 2/1992 | Affeldt et al. . | |
| 5,109,822 | 5/1992 | Martin | 123/447 |
| 5,311,850 | 5/1994 | Martin . | |
| 5,456,233 | 10/1995 | Felhofer | 123/447 |
| 5,505,181 | 4/1996 | McRae et al. . | |
| 5,513,613 | 5/1996 | Taylor et al. . | |
| 5,516,266 | 5/1996 | Talaski . | |
| 5,575,262 | 11/1996 | Rohde . | |
| 5,603,302 | 2/1997 | Minagawa et al. . | |
| 5,617,827 | 4/1997 | Eshleman et al. . | |
| 5,653,262 | 8/1997 | Killing . | |
| 5,746,255 | 5/1998 | Walsh | 138/30 |

*Primary Examiner*—Carl S. Miller

[57] ABSTRACT

A fuel rail damper for use within the fuel rail of an internal combustion engine includes a flexible tubular diaphragm which extends along the center of the fuel rail. The distal end of the tubular diaphragm is closed and the proximal end of the tubular diaphragm is open and connected to a diagnostic fitting at one end of the fuel rail. This fitting includes a diagnostic valve core and a cap which permit external servicing. The diagnostic fitting is removable which permits the fitting to be easily installed or removed, thus facilitating replacement of the fitting, if necessary. The diagnostic fitting is sealed after the tubular diaphragm is pressurized to a pressure below the operating pressure within the fuel rail.

26 Claims, 2 Drawing Sheets

FUEL RAIL DAMPER

BACKGROUND OF THE INVENTION

The invention relates to fuel rails for internal combustion engines, and more particularly to a fuel rail damper to reduce pressure pulsations in the fuel rail.

Fuel injection systems for automotive, internal combustion engines may use a number of fuel injectors, each of which delivers fuel to the inlet port of an engine combustion chamber. In some of these systems, the fuel injectors are mounted in sockets in a common fuel rail which supplies fuel to each of the injectors. The fuel rail simplifies installation of the fuel injectors and equalizes the delivery of fuel to the injectors.

When electromagnetic fuel injectors are used, the injectors deliver fuel to the engine in metered pulses which are timed to control the amount of fuel delivered and to coordinate the fuel delivery with the operation of the engine. The sequential activation of the fuel injectors coupled with low compliance in the fuel system results in pressure pulsations within the fuel rail which can result in fuel line pressure pulsations which inhibit the accurate delivery of fuel. More specifically, the variations in differential pressure across the injectors causes a variation of the amount of fuel that flows through each injector during the period in which it is open.

Dampers located external to the fuel rail have been used, but these dampers require additional space and are often difficult to locate and service. U.S. Pat. No. 5,617,827 issued to Eshleman et al. discloses a damper located within a fuel rail. The damper has two mated shells enclosing an air pocket, with the mated shells forming a peripheral flange that permits the damper to be secured and supported at both of the fuel rail ends by damper supports. However, the damper and damper supports add a level of complexity to the system that both increases costs and reduces accessibility to the fuel rail interior.

It is therefore an object of the present invention to provide a simpler and lower cost fuel rail damper that effectively reduces noise in the fuel rail. It is a further object of the invention to provide a damper that can be easily re-charged or replaced, and which can be used to monitor pressure conditions within the fuel rail.

SUMMARY OF THE INVENTION

The above-recited objects are achieved by providing a fuel rail damper that is located within the fuel rail of an internal combustion engine, and including a flexible tubular diaphragm which extends along the center of the fuel rail. The distal end of the tubular diaphragm is closed and the proximal end of the tubular diaphragm is open and connected to a diagnostic fitting at one end of the fuel rail. This fitting includes a diagnostic valve core and a cap which permit external servicing. The diagnostic fitting is removable which permits the fitting to be easily installed or removed, thus facilitating replacement of the fitting, if necessary. The diagnostic fitting connects to a complementary fuel rail fitting at one end of the fuel rail, as for example by threaded sealing. The tubular diaphragm is filled though the diagnostic valve core with a gas such as air or nitrogen to a pressure level below the operating pressure of the fuel rail. When the desired pressure is obtained, the tubular diaphragm is sealed by closing the valve core.

When pressurized, the tubular diaphragm acts as a compliant damper which acts to reduce the pressure variation (drop) which occurs when the injectors are energized, thus reducing the level of pressure pulsation. The damper of the present invention offers several advantages over existing dampers. The use of a tubular diaphragm connected at one end to the fuel rail simplifies the structure of the diaphragm within the fuel rail conduit and permits the damper to be easily installed, removed, re-charged and replaced. In addition, the use of a diagnostic fitting permits the pressure conditions within the fuel rail to be conveniently monitored without loss or exposure of fuel to the atmosphere.

The details of the preferred embodiment of the invention as well as other features and advantages are set forth in the following detailed description and drawings.

DETAILED DESCRIPTION

Figure 1:
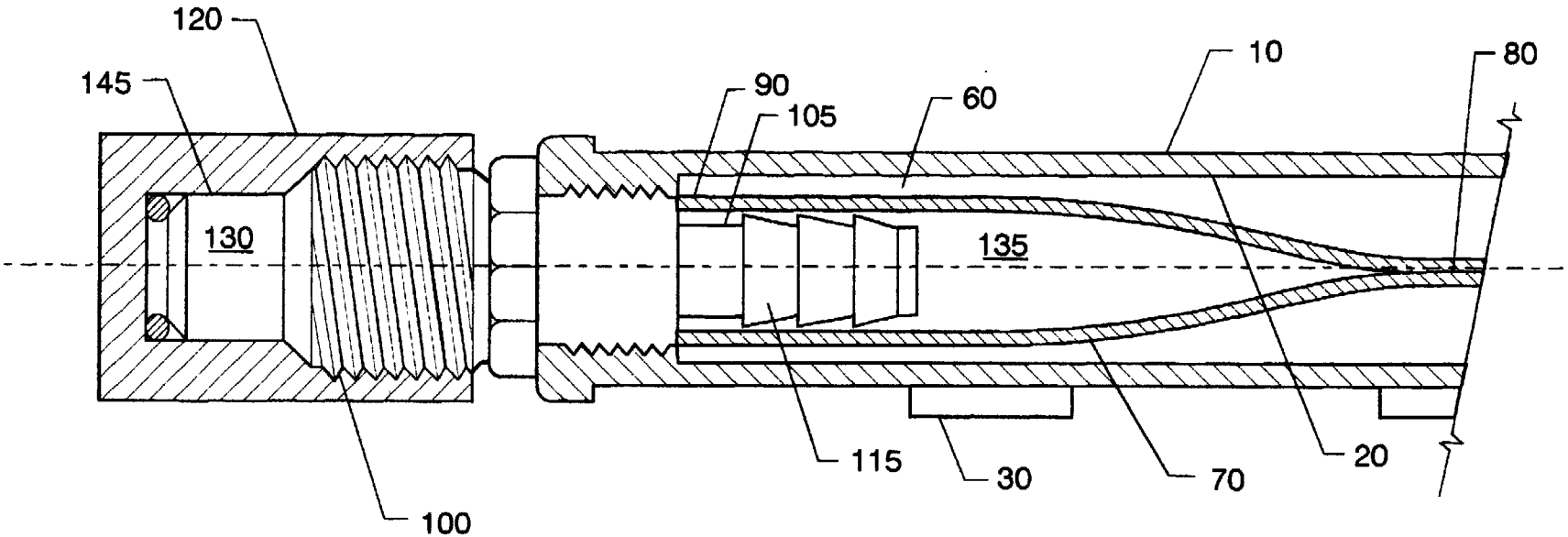
FIG. 1 is a cross sectional side view of the fuel rail damper of the present invention positioned within a portion of the fuel rail.

As shown in FIG. 1, the fuel rail 10 has a fuel supply conduit 20 that supplies fuel to the fuel injector sockets 30 that receive fuel injectors (not shown). The fuel rail 10 may be a molded plastic tube or a metal tube; however, the material used for the fuel rail may vary. A plurality of fuel injector sockets 30 extend from the exterior of the fuel rail 10 and have openings (not shown) which extend through the wall of the fuel rail 10 to intersect the fuel supply conduit 20 to supply fuel to each fuel injector socket 30 and its associated fuel injector (not shown). The fuel injectors are preferably conventional electromagnetic fuel injectors activated by a conventional electronic control unit to deliver timed pulses which energize the injector opening for the duration of the pulse and allow a controlled amount of fuel to flow into the engine.

A fuel rail damper 60 is disposed within the fuel supply conduit 20. The fuel rail damper 60 includes a flexible, elongated, tubular diaphragm 70 and a diagnostic fitting 100. The tubular diaphragm 70 is closed at the distal end 80 and open at the proximal end 90, and may be constructed of a thin-walled metal, nylon, plastic or any other material that is sufficiently compliant and impermeable to the fuel in the fuel supply conduit 20. As an example, the tubular diaphragm 70 may be made from a suitable nylon that has a thickness of about 0.03 to 0.04 inches (0.762 to 1.016 mm). The circumference of the tubular diaphragm 70 is less than the diameter of the fuel supply conduit 20. When the tubular diaphragm 70 extends only a short distance into the fuel supply conduit 20, and not as far as the first fuel injector, the cross sectional area of the diaphragm 70 can be almost equal to the diameter of the fuel supply conduit 20 as long as its position will not interfere with the flow of fuel to the injectors. A fuel supply conduit not having a internal fuel rail damper according to the present invention is designed to have a desired cross sectional area to permit the required fuel flow. Therefore, in the case where the tubular diaphragm 70 extends the full length of the fuel supply conduit 20, and thus occupies a determinable cross sectional area of the fuel supply conduit 20, the diameter of the fuel supply conduit 20 should be increased such that the cross sectional area available for fuel flow within the fuel supply conduit 20 remains constant, taking into account the cross sectional area which is unavailable for fuel flow due to the presence of the pressurized tubular diaphragm 70.

Although the tubular diaphragm 70 is illustrated as having the distal end 80 closed and sealed by welding, any appropriate method of sealing the distal end 80 may be used such as bonding or clamping. In addition the tubular diaphragm 70 may be formed, as for example by deep drawing or molding, to produce a closed distal end 80 that does not require additional sealing. Any tubular shape may be used for the diaphragm that permits it to easily collapse upon itself, including round, oval and angular and multi-sided.

Figure 2:
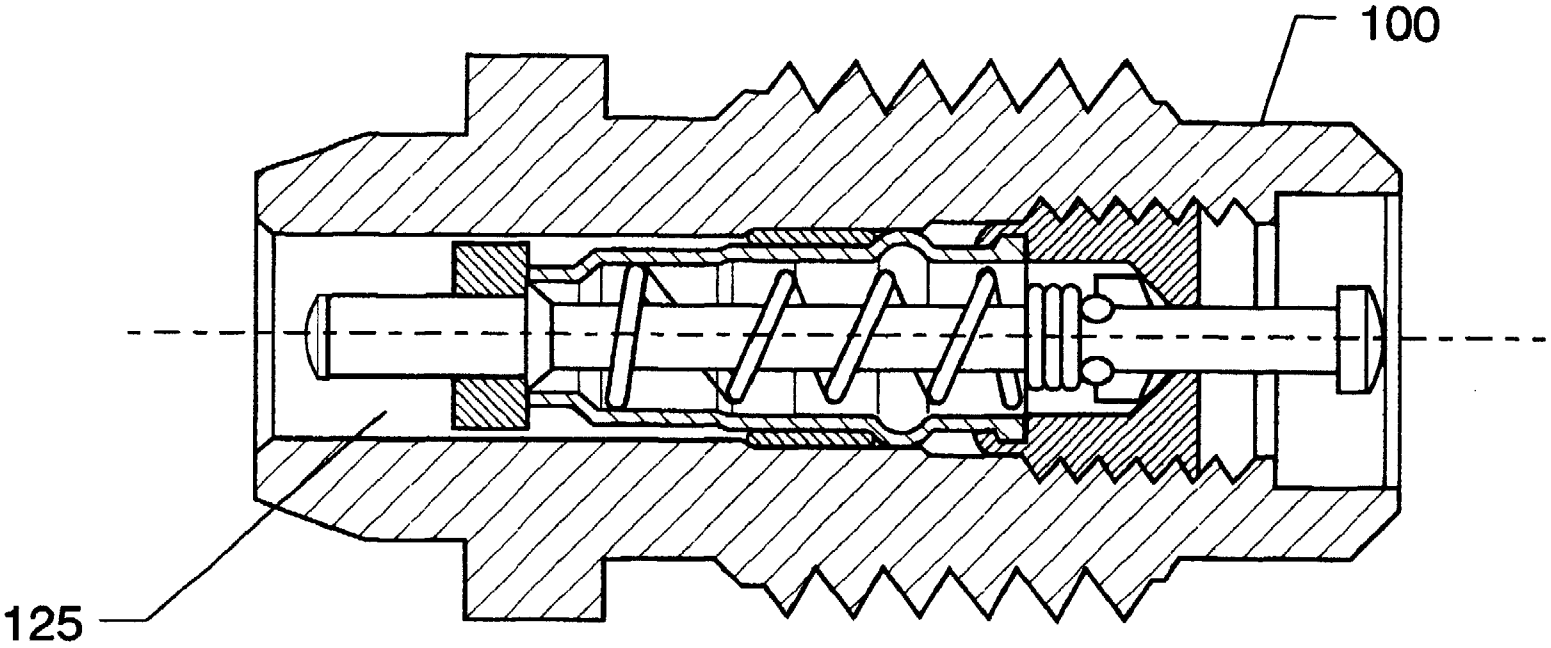
FIG. 2 is a cross sectional view of a diagnostic fitting with a valve core suitable for use in the fuel rail damper of FIG. 1.

The proximal end 90 of the tubular diaphragm 70 is releasably and sealably interconnected to the diagnostic fitting 100 by means of a hose barb 105, with the proximal end 90 of the tubular diaphragm 70 being secured by the barbs 115. The seal provided by connection of the tubular diaphragm 70 to the hose barb 105 is sufficient to maintain a desired pressure within the diaphragm 70 when it is pressurized and during operating conditions of the fuel rail 10. Operating pressures within fuel rails vary according to the design of the engine and are routinely determinable by those skilled in the art. The diagnostic fitting 100 has a valve core 125 that permits measurement of pressure within the tubular diaphragm 70. Suitable valve cores are commercially available, and an acceptable valve core within a diagnostic fitting for use in the present invention is shown in FIG. 2. Any of a number of conventional diagnostic fittings may be used that have valve cores to permit pressure within the tubular diaphragm to be measured and permit air or another desired gas to be introduced or removed from the tubular diaphragm 70.

A removable cap 120 is attached to the diagnostic fitting 100 to permit external servicing of the fuel rail damper 60. The cap may be a protective cap which prevents unintentional activation of the valve. In addition, the protective cap may provide a single secondary seal and prevent contamination of the valve area and sealing area where a gauge and or instrumentation is attached to the fitting. The diagnostic fitting 100 is removable from the fuel rail 10 to permit the fitting 100 and the tubular diaphragm 70 to be easily installed and removed. The diagnostic fitting 100 screws into a threaded fuel rail fitting 130 at the end of the fuel rail 10 and is sealed, as for example by either interference threads or an AN type O-ring seal.

After the fuel rail damper 60 is positioned into the fuel rail conduit 20 and secured to the fuel rail fitting 130, the tubular diaphragm 70 is pressurized by adding a gas such as air or nitrogen to the air chamber 135 defined by the tubular diaphragm 70 and the diagnostic fitting 100 to a pressure below the anticipated operating pressure within the fuel rail 10. Thus, the tubular diaphragm 70 will then be unloaded, and not in tension, when the pressurized fuel surrounds it. The compressibility of the air or nitrogen within the tubular diaphragm 70 will equalize and balance the fuel pressure to provide the desired damping. The length of the tubular diaphragm 70 may be varied to provide the desired amount of damping. For example, if higher damping and quicker damping response is desired, the tubular diaphragm 70 may extend substantially the full length of the fuel supply conduit 20. The extended length of the tubular diaphragm 70 provides an increased volume in the air chamber 135 and positions the diaphragm 70 closer to the pressure waves emanating from the fuel injector sockets 30. If a lower level of damping is desired, the length of the tubular diaphragm 70 may be shortened. The diameter of the tubular diaphragm 70 is less than the diameter of the fuel supply conduit 20, and must be sized to permit the desired flow of fuel in the fuel supply conduit 20 to the fuel injectors.

In service, the proximal end 145 of the diagnostic fitting 100 can be used to check fuel pressure in the fuel supply conduit 20 by attaching a pressure gauge (not shown) to the diagnostic fitting 100 at the valve core 125 and measuring the pressure increase when the engine is started, and the fuel pressure is stabilized by the pressure regulator (not shown). If the pressure is lost in the tubular diaphragm 70 during field service it can be recharged through the diagnostic fitting 100 using conveniently available pressurized air such as shop air, regulated to the proper pressure while the engine is not running. If the tubular diaphragm 70 develops a leak, the diagnostic fitting 100 and cap 120 will prevent an external leak of fuel and the entire fuel rail damper 60 can be replaced. Thus, this assembly provides an added measure of fuel leak prevention over the conventional diagnostic fitting installations.

It is understood that, while the detailed description and drawings show specific examples of the present invention, they are for the purposes of illustration only. The present invention is not limited to the precise details and conditions disclosed. For example, the diagnostic fitting 100 may be replaced with a non-diagnostic, support fitting that does not have a valve core. In this embodiment, the pressurized tubular diaphragm 70 would be connected to the support fitting prior to insertion of the fuel rail damper 60 into the fuel rail 10. Although this embodiment would not permit in-situ monitoring of the fuel pressure within the fuel conduit 20, it would be easy to install, remove and replace, and would cost less than the fuel rail damper embodiment using a diagnostic fitting. In addition, in this embodiment a cap would not be needed at the support fitting.

Although the diagnostic fitting, and the support fitting, have been described as connected to the inside of the fuel rail by threaded engagement, it should be understood that the fitting can be attached to and seal to the fuel rail by other means such as clamps, threaded engagement to the outside surface of the fuel rail, and any other means of attachment that permits the fittings to be releasably attached to the end of the fuel rail, while also effectively closing and sealing the end of the fuel rail.

The use of a tubular hose barb has been illustrated as a method of releasably and sealably attaching the tubular diaphragm to the fitting. However, other permissible means of attachment may be used. As examples only, the tubular diaphragm may be slid over a non-barbed tube and held in place by an O-ring or a hose clamp; or the hose barb can be a solid, non-tubular in construction when a non-diagnostic fitting is used.

What is claimed is:

1. A fuel rail damper for use within a fuel supply conduit of a fuel rail, the fuel rail damper comprising:

a tubular diaphragm having a proximal end and a distal end, the tubular diaphragm being flexible and the distal end of the tubular diaphragm being closed; and a fitting having a first end and a second end, the fitting being adapted to be capable of sealable connection to an end of the fuel rail, wherein the proximal end of the tubular diaphragm is sealably attached to the first end of the fitting to form a closed air chamber in the tubular diaphragm.

2. The fuel rail damper of claim 1, wherein the pressure of the air in the air chamber is less than an operating pressure within the fuel supply conduit.

3. The fuel rail damper of claim 2, wherein the fitting is a diagnostic fitting.

4. The fuel rail damper of claim 3, wherein the diagnostic fitting includes a valve core.

5. The fuel rail damper of claim 4, further including a cap that is in sealing attachment to the second end of the fitting.

6. The fuel rail damper of claim 5, wherein the proximal end of the tubular diaphragm is releasably connected to the first end of the fitting.

7. The fuel rail damper of claim 6, wherein the fitting is releasably connected to the end of the fuel rail.

8. The fuel rail damper of claim 7, further comprising a hose barb which sealingy interconnects the proximal end of the tubular diaphragm to the first end of the fitting.

9. A fuel rail damper assembly for an internal combustion engine, said fuel rail damper assembly comprising:

a fuel rail having a fuel supply conduit with a first cross sectional area;

a tubular diaphragm disposed within the fuel supply conduit and having a proximal end and a distal end, the tubular diaphragm being flexible, the distal end of the tubular diaphragm being closed, and the tubular diaphragm having a second cross sectional area that is smaller than the first cross sectional area; and a fitting adapted to be capable of sealable connection to one end of the fuel rail, wherein the proximal end of the tubular diaphragm is sealably attached to the fitting to form a closed air chamber in the tubular diaphragm.

10. The fuel rail damper of claim 9, wherein the difference between the first cross sectional area and the second cross sectional area is sufficient to permit a desired fuel flow through the fuel supply conduit.

11. The fuel rail damper of claim 10, wherein the pressure of the air in the air chamber is less than an operating pressure within the fuel supply conduit.

12. The fuel rail damper of claim 11, wherein the fitting is a diagnostic fitting.

13. The fuel rail damper of claim 12, wherein the diagnostic fitting includes a valve core.

14. The fuel rail damper of claim 13, further including a cap that is in sealing attachment to the second end of the fitting.

15. The fuel rail damper of claim 14, wherein the proximal end of the tubular diaphragm is releasably connected to the first end of the fitting.

16. The fuel rail damper of claim 15, wherein the fitting is releasably connected to the end of the fuel rail.

17. The fuel rail damper of claim 16, further comprising a hose barb which sealingy interconnects the proximal end of the tubular diaphragm to the first end of the fitting.

18. A method of damping pressure fluctuations in a fuel rail of an internal combustion engine, the fuel rail having a fuel supply conduit for directing fuel to fuel injectors, the fuel supply conduit having a first cross sectional area, said method of damping pressure fluctuations comprising the steps of:

a) providing a fuel rail damper, said fuel rail damper having a tubular diaphragm having a proximal end and a distal end, the tubular diaphragm being flexible and the distal end of the tubular diaphragm being closed, and the tubular diaphragm having a second cross sectional area that is smaller than the first cross sectional area; and a fitting adapted for sealable connection to one end of the fuel rail, wherein the proximal end of the tubular diaphragm is sealably attached to the fitting to form a closed air chamber in the tubular diaphragm; and b) attaching the fitting to the one end of the fuel rail to form a sealed attachment such that the tubular diaphragm extends into the fuel supply conduit.

19. The method of claim 18, wherein the difference between the first cross sectional area and the second cross sectional area is sufficient to permit a desired fuel flow through the fuel supply conduit.

20. The method of claim 19, further comprising the step of pressurizing the air chamber to a pressure less than an operating pressure within the fuel supply conduit.

21. The method of claim 20, wherein the fitting is a diagnostic fitting.

22. The method of claim 21, wherein the diagnostic fitting includes a valve core.

23. The method of claim 22, further including the step of sealingly attaching a cap to the second end of the fitting.

24. The method of claim 23, wherein the proximal end of the tubular diaphragm is releasably connected to the first end of the fitting.

25. The method of claim 24, wherein the fitting is releasably connected to the end of the fuel rail.

26. A fuel rail damper for use within a fuel supply conduit of a fuel rail, the fuel rail damper comprising:

a tubular diaphragm having a proximal end and a distal end, the tubular diaphragm being flexible and the distal end of the tubular diaphragm being closed;

a fitting having a first end and a second end;

means for sealably connecting the fitting to an end of the fuel rail; and means for sealably attaching the proximal end of the tubular diaphragm to the first end of the fitting to form a closed air chamber in the tubular diaphragm.

* * * * *